United States Patent [19]

Doyle

[11] 4,317,442

[45] Mar. 2, 1982

[54] FIREPLACE HEATING UNIT

[76] Inventor: John R. Doyle, 234 Edna St., Poland, Ohio 44514

[21] Appl. No.: 146,650

[22] Filed: May 5, 1980

[51] Int. Cl.[3] ..... F24B 7/00

[52] U.S. Cl. ..... 126/121; 126/138; 237/51

[58] Field of Search ..... 126/121, 99 A, 109, 126/123, 140, 138; 165/175, DIG. 2; 237/51; D23/94, 97; 138/106; 248/68 R, 73, 67.5, 74 R

[56] References Cited

U.S. PATENT DOCUMENTS

| | | | |
|---|---|---|---|
| 826,300 | 7/1906 | Wilson | 248/68 R |
| 2,359,197 | 9/1944 | Brooks | 126/121 |
| 3,854,684 | 12/1974 | Moore | 248/68 R |
| 3,930,490 | 1/1976 | Lassy et al. | 126/121 |
| 4,008,707 | 2/1977 | Bartlett | 126/131 |
| 4,019,492 | 4/1977 | Rush | 126/121 |
| 4,091,794 | 5/1978 | Stites | 126/121 |
| 4,217,880 | 8/1980 | Turner, Jr. | 126/121 |
| 4,219,005 | 8/1980 | Boahn | 126/121 |

*Primary Examiner*—Samuel Scott
*Assistant Examiner*—Randall L. Green
*Attorney, Agent, or Firm*—Harpman & Harpman

[57] ABSTRACT

A fireplace heating unit for use in a conventional fireplace comprises a plurality of vertically spaced horizontally positioned curved tubes that are positioned outwardly of the inner walls of the fireplace and extend into a front enclosure that closes the opening of the fireplace. The ends of the tubes are open so that air can be circulated through the tubes and enclosure.

4 Claims, 5 Drawing Figures

FIREPLACE HEATING UNIT

BACKGROUND OF THE INVENTION (1) Field of the Invention

This invention relates to heaters that can be used in a conventional fireplace to provide more efficient use of the heat energy released therein.

(2) Description of the Prior Art

Prior art devices have used a number of different heat exchangers. See for example U.S. Pat. Nos. 4,008,707, 3,930,490 and 4,019,492.

In U.S. Pat. No. 3,930,490, a heater is disclosed having vertical and horizontal tubes running around the sides and over the top of the fire supporting grate.

In U.S. Pat. No. 4,008,707, a removable heater is disclosed having large hollow wall sections adapted to fit the interior of a fireplace. The hollow sections have corrugated inner walls for increased heat transfer.

U.S. Pat. No. 4,019,492 shows an automatic furnace which uses a number of horizontally disposed pipes above and behind the combustion area. Combustion air is supplied by a perforated air delivery tube which appears to be the novelty in the disclosure.

Applicant's device uses a number of semi-U shaped horizontal tubes in vertically spaced relation to one another that conform generally to the shape of the inner back and side walls of a conventional fireplace.

SUMMARY OF THE INVENTION

An air heating unit that can be placed in a conventional fireplace to increase heating efficiency. The heating unit is comprised of a number of vertically spaced horizontally positioned generally U-shaped tubes that extend around the inner walls of the fireplace conforming to the normal inward slant of the back wall. The ends of the tubes extend through openings in a closure positioned across the opening of the fireplace so that air can be circulated therethrough.

DESCRIPTION OF THE PREFERRED EMBODIMENT

Figure 1:
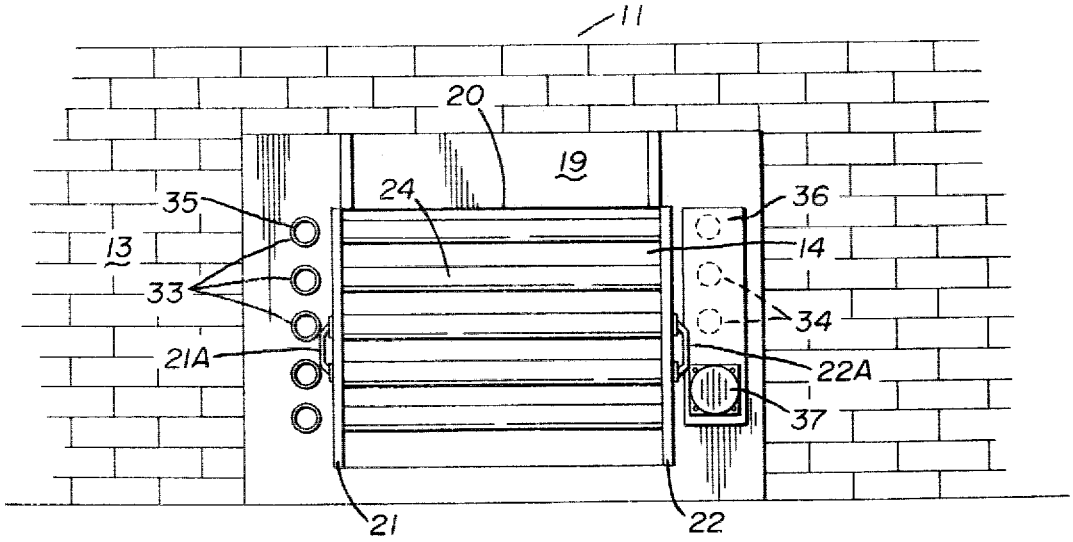
FIG. 1 is a front elevational view of a fireplace with the heater positioned therein.
Figure 2:
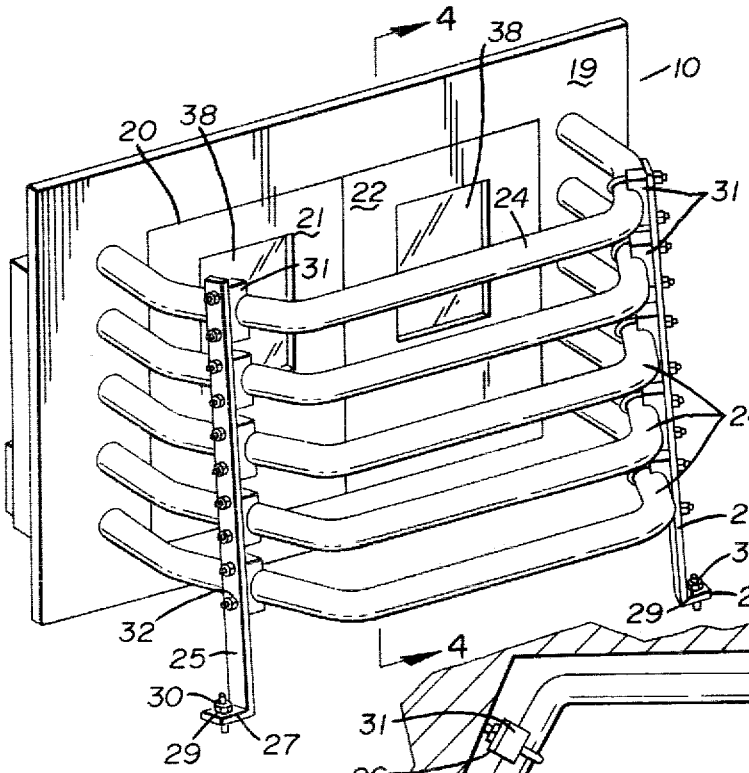
FIG. 2 is a rear perspective view of the heater.
Figure 3:
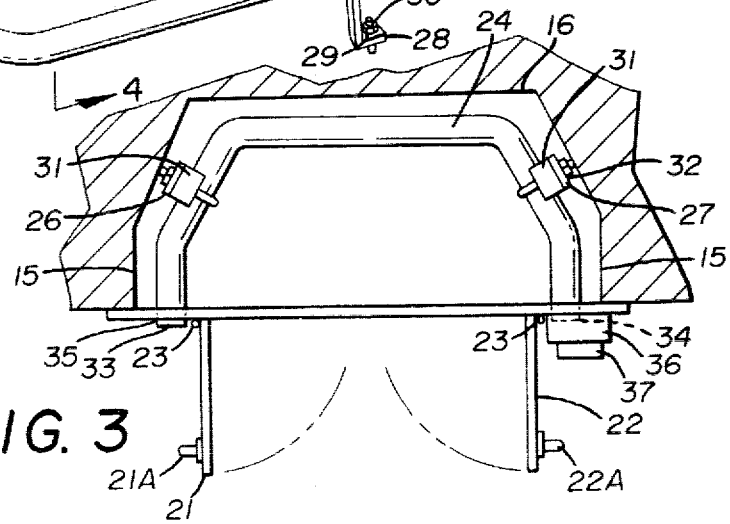
FIG. 3 is a top plan view of the heater.
Figure 4:
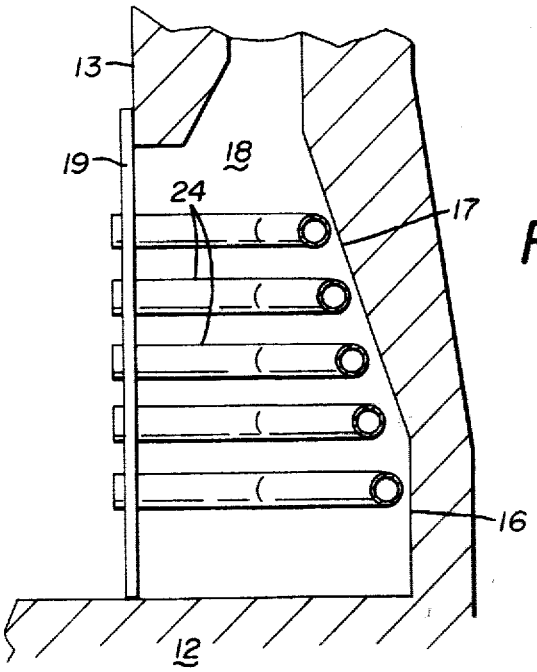
FIG. 4 is a vertical section on lines 4—4 of FIG. 3.

A heater 10 as seen in FIGS. 1, 2 and 3 of the drawings is positioned within a conventional fireplace 11 having a hearth 12, a facing 13, and an opening 14. The interior of the fireplace 11 has vertical side walls 15 and a rear wall 16 with a forwardly sloping upper portion 17.

A passageway 18 communicates with the top of the fireplace and a chimney, not shown. The fireplace heater 10 is comprised of a wide rectangular metal frame 19 having a large opening 20 therein. A pair of doors 21 and 22 which have handles 21A and 22A respectively, are pivotally secured to the frame 19 by several hinges 23 as best seen in FIG. 3 of the drawings. The doors 21 and 22 normally close the opening 14. Several horizontally positioned, generally U-shaped metal tubes are arranged in vertically spaced relation to one another by a pair of support members 25 and 26. The members 25 and 26 are elongated with their lower ends 27 and 28 formed at right angles thereto. The ends 27 and 28 are apertured at 29 to receive bolts 30 that can be adjusted to raise or lower the support members 25 and 26.

A plurality of U-shaped clamps 31 are positioned in openings 32 in the members 25 and 26. The clamps 31 engage the tubes 24 so as to hold the tubes 24 in spaced relation to the members 25 and 26 and in spaced relation to each other.

Referring now to FIGS. 1 and 2 of the drawings, the tubes 24 will be seen to have open ends 33 and 34 that extend through registering openings 35 in the frame 19. A rectangular enclosure 36 on the frame 19 is positioned over and in communication with the open tube ends 34. A blower 37 is in communication with the enclosure 36 and is powered by conventional AC electric motor with a 110 AC power source as normally available in residential housing.

In operation, air from the room in which the fireplace is located, is moved through the tubes 24 by the blower 36 and heated by the combustion of the wood or other fuel within the fireplace 11. The heated air exits the tube ends 33 directly into the room. The doors 21 and 22 can be closed concentrating the heat energy released by combustion within the fireplace 11 providing increased thermal efficiency in the tubes 24. View ports or windows 38 are provided in the doors 21 and 22 as seen in FIG. 2 of the drawings so that the fire can be monitored by the user.

Figure 5:
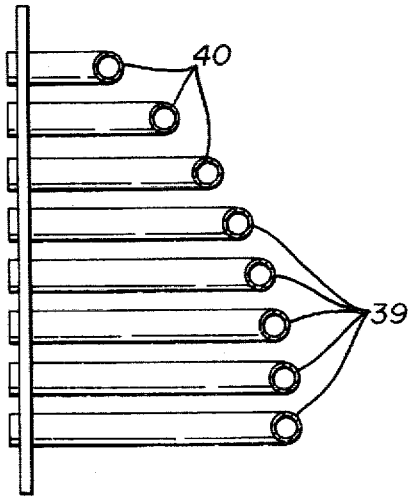
FIG. 5 is a vertical section of an alternate modified construction of the heater.

An alternate construction will be seen in FIG. 5 of the drawings that provides an increased number of tubes 39 in the fire area and shortens the upper tubes 40 thereof so as to locate them above and around the fire area.

It will thus be seen that an approved heat exchanger has been disclosed that can be advantageously used in a fireplace.

What is claimed is:

1. An improvement in a heater for use in a fireplace having rear and side walls and an open front, the improvement comprising a plurality of horizontally positioned generally U-shaped heat exchange tubes with open ends arranged in vertically spaced relation to one another, means for supporting and spacing said tubes in the fireplace adjacent said rear and side walls so that heat from a fire in the fireplace will heat the tubes and air within them, means for circulating air through said tubes, a wide frame having openings therein with which the ends of the tubes communicate positioned across the open front of the fireplace, a pair of doors on said wide frame for closing the area defined by said frame, said air circulating means being in communication with one of said open ends of each of said heat exchange tubes, a portion of each of said heat exchange tubes being offset horizontally with respect to an adjacent tube.

2. The improvement in a heater set forth in claim 1 wherein said heat exchange tubes are of the same cross sectional diameter and of different lengths with the longest length tube being positioned in the lower part of said vertically spaced arrangement and the shortest length tube being positioned in the upper part of said arrangement.

3. The improvement in a heater set forth in claim 1 wherein said means for supporting and spacing said tubes comprise vertically positioned elongated support members and said wide frame, said support members being spaced with respect to said wide frame, clamps secured to said elongated support members in spaced relation to one another and secured to said tubes.

4. The improvement in a heater set forth in claim 1 wherein said air circulating means comprises an enclosure in communication with one of the ends of each of said tubes and mounted on said wide frame and a blower and electric motor in communication with said enclosure.

* * * * *